US006047828A

United States Patent [19]

Hay et al.

[11] Patent Number: 6,047,828

[45] Date of Patent: Apr. 11, 2000

[54] POLYOLEFIN DRUMS

[76] Inventors: Henry F. Hay, 20 Harvest Oak Place NE., Calgary, Canada, T3K 4C9; W. Laurie Douglas, 12081 Diamond View SE., Calgary, Canada, T2J 7B2; James Jeffrey Preece, 219 Norfolk Road., NW., Calgary, Canada, T2K 5N6; Mark Aubee, 602 - 23 Avenue. NE., Calgary, Canada, T2E 1W4; Nancy Conley, 25 Cadillac Street, Kirkland, Canada, H9H 4E5

[21] Appl. No.: 09/034,523

[22] Filed: Mar. 3, 1998

[30] Foreign Application Priority Data

Mar. 10, 1997 [CA] Canada ..... 2199551

[51] Int. Cl.[7] ..... B45D 85/84

[52] U.S. Cl. ..... 206/524.4; 206/524.6; 524/108; 428/36.92

[58] Field of Search ..... 524/108; 206/524.4, 206/524.6; 428/138, 36.92; 264/533

[56] References Cited

U.S. PATENT DOCUMENTS

| | | | |
|---|---|---|---|
| 4,397,916 | 8/1983 | Nagano | 428/46 |
| 4,954,291 | 9/1990 | Kobayashi et al. | 524/108 |
| 5,001,176 | 3/1991 | Nakazima | 524/108 |
| 5,049,605 | 9/1991 | Rekers | 524/108 |
| 5,198,484 | 3/1993 | Mannion | 524/108 |

*Primary Examiner*—Veronica P. Hoke
*Attorney, Agent, or Firm*—Kenneth H. Johnson

[57] ABSTRACT

Polyolefin drums in which the olefin polymer has been nucleated with from 1,500 to 10,000 ppm based on the weight of the polyolefin of a nucleating agent which is a dibenzylidene derivative of sorbitol or xylitol can, when full of liquid, withstand a drop of at least 10 feet without failure.

1 Claim, No Drawings

POLYOLEFIN DRUMS

FIELD OF THE INVENTION

The present invention relates to blow molded polyolefin containers. More particularly the present invention relates to large containers for liquids which can, when full of liquid, withstand a fall of at least 10 feet (3 meters) without splitting. More particularly the present invention relates to a blow molded 45 gallon drum (about 200 l) and the like which when full of liquid are capable of withstanding a fall of at least 3 meters without breaking.

BACKGROUND OF THE INVENTION

The metal 45 gallon drum has long been a standard industrial container. There have been a number of attempts in the past to replace the steel in the drum with various polymers. Particularly, there has been a desire to replace the steel with olefin polymers and in particular polyethylene. One of the difficulties which has been noted with polyethylene is the difficulty in decreasing the crystal size. While crystal size may be decreased in other polymers using nucleating agents, the crystal size in polyethylene does not seem to be significantly affected by the presence of nucleating agents. As a result, large blow molded containers of polyethylene tend to lack the desired combinations of stiffness and toughness (e.g. being tough but flexible as opposed to brittle). This results in limitations with regard to the number of polyolefin drums which may be stacked upon each other and also a tendency of the filled containers to break or split when dropped from a height of less than about 10 feet (3 meters).

To the best of Applicants' knowledge this drawback has not been solved.

U.S. Pat. No. 5,198,484 issued Mar. 30, 1993 to Michael J. Mannion, assigned to Milliken Research Corporation discloses the use of derivatives of sorbitol and xylitol as clarifying agents in polyolefins and in particular polyethylene and polypropylene. The patent teaches that the bubbles may be reduced in products fabricated from polyolefins containing such agent by dissolving the "clarifying" agent in the polyolefin at a temperature of at least 170° C. However, the patent does not suggest any particular applications in which the polyolefins containing such "clarifying" agents are useful.

The present invention seeks to overcome the existing drawbacks with regard to industrial drums and containers by incorporating such "clarifying" agents into the polyolefins used to manufacture such containers.

SUMMARY OF THE INVENTION

The present invention provides a blow molded polyolefin container for liquids having a volume of from 25 to 75 gallons capable of withstanding a fall of not less than 10, preferably more than 12, most preferably at least 14 feet when full of liquid wherein the walls of said container comprise at least one layer of polyolefin having a density from 0.940 to 0.970 g/cm$^3$, which polyolefin has been nucleated with from 1500 to 10,000 parts per million based on the weight of the polyolefin of a nucleating agent of the formula:

I

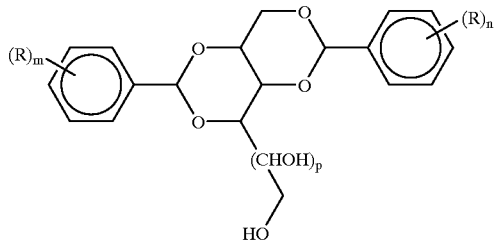

wherein each R is independently selected from the group consisting of $C_{1-8}$ alkyl radicals, $C_{1-4}$ hydroxyalkyl radicals, a hydroxy radical or a halogen atom, $C_{1-6}$ alkylthio radicals, $C_{1-6}$ alkylsulfoxy radicals; p is 0 or 1 and m and n are independently an integer from 0 to 3.

DETAILED DESCRIPTION

The olefin polymer suitable for use in the present invention is typically a polymer comprising at least 80, preferably 90 weight % of a monomer selected from the group consisting of ethylene and propylene, preferably ethylene, and up to 20, preferably not more than 10 weight % of one or more $C_{4-10}$, preferably $C_{4-8}$ copolymerizable alpha olefins. The polymer may be a homopolymer of ethylene or may be a copolymer of ethylene and one or more of a higher alpha olefin such as 1-butene, 1-hexene or 1-octene, preferably butene.

The polyolefin will have a density of greater than 0.935 g/cm$^3$, preferably from 0.940 to 0.970 g/cm$^3$, most preferably from 0.950 to 0.960 g/cm$^3$. Typically the polyolefin will have a melt index (grams of polymer which can be extruded from a 0.0825 inch orifice in 10 minutes at 190° C. under a force of 2.160 kg) of less than 0.5, preferably less than 0.1. Another flow rate typically used in industry is the melt flow rate which is the amount of polymer extruded under a 21 kg load under essentially the same conditions for the melt index. The polymer should have a melt flow rate of less than 10, most preferably less than 5 g/10 min.

The polyolefin may be produced by a number of methods, such as gas phase, slurry and solution phase polymerization. These methods are well known to those skilled in the art and are disclosed in a number of patents filed in the names of Union Carbide Corporation, Union Carbide Chemicals & Plastics Technology Corporation, BP Chemicals, Phillips, The Dow Chemical Company and DuPont Canada Inc. A good survey of the technology relating to the manufacture of polyethylene is the paper *Gas Phase Ethylene Polymerization: Production Processes, Polymer Properties and Reactor Modeling*, Ind. Eng. Chem. Res. 1994, 33, 449–479 by Tuyu Xie, Kim B. McAuley, James C. C. Hsu, and David W. Bacon. From the above paper: generally gas phase polymerization may be carried out in a fluidized bed or a stirred bed reactor at temperatures from about 80–100° C., pressures from about 15–40, typically less than 20 atm. in the presence of a co-ordination catalyst typically based on Ti or $CrO_3$, to produce a homopolymer of ethylene or a copolymer of ethylene and one or more of 1-butene and 1-hexene having density up to 0.970 g/cm$^3$; slurry phase polymerization is carried out in a continuous stirred tank reactor (CSTR) or a loop reactor at pressures of 30–35 atmospheres at temperatures from about 85 to 110° C. in the presence of co-ordination catalysts to produce homopolymers and copolymers of ethylene having a density of up to about 0.970 g/cm$^3$; and solution phase polymerization is conducted in a CSTR at pressures below 100 atm., temperatures from about 140–200° C., in the presence of co-ordination catalysts to produce homo and copolymers of ethylene (in which the comonomer may also include octene) having a density up to 0.970 g/cm$^3$.

The nucleating agent in accordance with the present invention has the formula

I

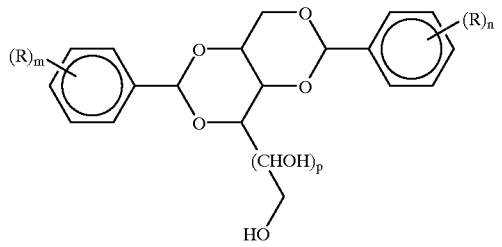

wherein each R is independently selected from the group consisting of $C_{1-8}$ alkyl radicals, $C_{1-4}$ hydroxyalkyl radicals, a hydroxy radical or a halogen atom, $C_{1-6}$ alkylthio radicals, $C_{1-6}$ alkylsulfoxy radicals; p is 0 or 1 (D-xylitol and D-sorbitol derivatives respectively) and m and n are independently an integer from 0 to 3. Preferably, in formula I each R is independently selected from the group consisting of $C_{1-4}$ alkyl radicals and m and n are selected from the group consisting of 0,1 and 2 and p is 1 (e.g. sorbitol derivatives). Most preferably the nucleating agent is selected from the group consisting of dibenzylidene sorbitol (e.g. m and n are 0 and R is a hydrogen atom), di (p-methyl benzylidene) sorbitol (m and n are 1 and R is methyl), di (o-methyl benzylidene) sorbitol (m and n are 1 and R is methyl), di (p-ethylbenzylidene) sorbitol (m and n are 1 and R is ethyl), bis (3,4-dimethyl benzylidene) sorbitol (m and n are 2 and R is methyl), bis (3,4-diethylbenzylidene) sorbitol (m and n are 2 and R is ethyl), and bis trimethylbenzylidene) sorbitol (m and n are 3 and R is methyl). One commercially available nucleating agent is bis (3,4-dimethyl benzylidene) sorbitol.

The nucleating agent may be used in amounts from about 1,500 to about 10,000 parts per million (ppm) based on the weight of the polyolefin. Preferably the nucleating agent is used in amounts from, 2,000 to 8,000, most preferably from 2,000 to 5,000 ppm based on the weight of the polyolefin.

The polyolefin may contain fillers and other additives. Typically the fillers are inert additives such as clay, talc, $TiO_2$ and calcium carbonate which may be added to the polyolefin in amounts up about 50, preferably less than 30 weight %. The polyolefin may contain typical amounts of antioxidants and heat and light stabilizers such as combinations of hindered phenols and one or more of phosphates, phosphites, and phosphonites typically in amounts of less than 0.5 weight % based on the weight of the polyolefin. Pigments may also be added to the polyolefin in small amounts.

The nucleating agent is blended with the polyolefin preferably in accordance with the teachings of U.S. Pat. No. 5,198,484—melt blending at a temperature above 170° C. a small particle size (from 176 to 420 m$\mu$ or passing through ASTME 11-61 40 mesh screen but not passing through ASTME 11-61 80 mesh screen) nucleating agent.

In practice the components for the container may be dry blended and then passed through an extruder, most preferably a high shear mixing extruder, into a blow molding device at a temperature from abut 200 to 280° C., preferably from about 230 to 250° C. The polyolefin is extruded as a parison and set in a mold. An air injector is introduced into the parison and the parison is expanded with air to conform to the inner shape of the mold. The mold is cooled and opened and the part ejected from the mold.

The present invention may be practiced with multilayer products. In which case the parison is formed from two or more coextruded compositions. The product may have an inner or outer layer of high density polyethylene (HDPE), or may have both an inner and outer layer of HDPE. In a layered or laminated product not all layers need contain the nucleating agent. The layer containing the nucleating agent would be a predominant layer (e.g. at least about 75% of the wall thickness) and the other layers would be thinner (e.g. less than 25% of the wall thickness). Typically the wall layer would be from about ⅛ to ¼ inch (30 to 60 mm) thick with inner and/or outer layers being less than about ⅛ inch (30 mm) thick.

The present invention will be illustrated by the following non-limiting example in which, unless otherwise indicated, parts means parts by weight and % means weight %.

EXAMPLE 1

In the examples NOVAPOL high density resin HB -W 355 having a density of 0.955 g/Cm$^3$ and a melt flow rate $I_{21}$2–4 g/10 minutes under a load of 21 kg for 10 minutes. The polymer contained about 0.10 weight % of each of a hindered phenol antioxidant and a phosphite heat and light stabilizer (secondary antioxidant).

The control sample was extrusion blow molded to form a 45 gallon drum without any additional additives. In the example 2,000 ppm of bis (3,4-dimethyl benzylidene) sorbitol sold under the trademark MILLAD 3988 was added to the polyethylene. The drums were filled with water, sealed with a lid also molded with the same polymer and dropped from various heights onto a concrete pad. The height of the drop and whether the drum passed (did not split) or failed (split) was recorded and the results analyzed using the Bruceton-staircase technique to calculate the impact resistance in terms of the height of fall the drum could withstand. The results for the control sample are set forth in table 1. In table 1 the drop height is in feet and the pass is indicated by O and a fail (cracking) by X.

TABLE 1

| Drop Height (ft) | 1 | 2 | 3 | 4 | 5 | 6 | 7 | 8 |
|---|---|---|---|---|---|---|---|---|
| 14 | | | | | | | | |
| 12 | X | | | | X | | | |
| 10 | | X | | O | | X | | X |
| 8 | | | O | | | | O | |
| 6 | | | | | | | | |

The impact resistance in terms of the height the drum could be dropped and not break is calculated to be 10+(⅖−0.5)=9.9 feet.

The results of the impact test for the drum prepared in accordance with the present invention is set forth in table 2 below.

TABLE 2

| Drop Height (ft) | 1 | 2 | 3 | 4 | 5 | 6 | 7 | 8 | 9 | 10 | 11 | 12 |
|---|---|---|---|---|---|---|---|---|---|---|---|---|
| 18 | | | | | | | | | | | | |
| 16 | | | | X | | | | X | | | | X |
| 14 | | | O | | X | | O | | X | | O | |
| 12 | | O | | | | O | | | | O | | |
| 10 | O | | | | | | | | | | | |

The impact resistance in terms of the height the drum could be dropped and not break is calculated to be 14+(¾−0.5)=14 feet.

The present invention provides about a 40% improvement in the drop resistance of polyolefin drums.

What is claimed is:

1. A blow molded polyolefin container having a volume of from 25 to 75 gallons capable of withstanding a fall of not less than 10 feet when full of liquid said container having walls which are single polyolefin layer having a thickness from 30 to 60 mm, said polyolefin having a density from 0.940 to 0.970 g/cm$^3$ being a homopolymer of ethylene or a copolymer of at least 80 weight % of ethylene and up to 20 weight % of one or more monomers selected from the group consisting of 1-butene, 1-hexene and 1-octene, and being nucleated with from 1,500 to 10,000 parts per million based on the weight of polyolefin of bis (3,4-dimethyl benzylidene) sorbitol.

* * * * *